US010100387B2

(12) United States Patent
Horie

(10) Patent No.: US 10,100,387 B2
(45) Date of Patent: Oct. 16, 2018

(54) COPPER-TITANIUM ALLOY FOR ELECTRONIC COMPONENT

(71) Applicant: JX Nippon Mining & Metals Corporation, Tokyo (JP)

(72) Inventor: Hiroyasu Horie, Ibaraki (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 134 days.

(21) Appl. No.: 15/037,061

(22) PCT Filed: Sep. 11, 2014

(86) PCT No.: PCT/JP2014/074125

§ 371 (c)(1),
(2) Date: May 17, 2016

(87) PCT Pub. No.: WO2015/072221

PCT Pub. Date: May 21, 2015

(65) Prior Publication Data

US 2016/0304990 A1 Oct. 20, 2016

(30) Foreign Application Priority Data

Nov. 18, 2013 (JP) ..... 2013-238335

(51) Int. Cl.

| | |
|---|---|
| ***C22C 9/00*** | (2006.01) |
| ***C22F 1/08*** | (2006.01) |
| ***H01B 1/02*** | (2006.01) |
| ***B22D 7/00*** | (2006.01) |
| ***B22D 27/00*** | (2006.01) |
| ***B22D 27/15*** | (2006.01) |
| ***C22C 1/02*** | (2006.01) |
| ***H01R 13/03*** | (2006.01) |
| *C22F 1/00* | (2006.01) |

(52) U.S. Cl.

CPC ..... *C22C 9/00* (2013.01); *B22D 7/005* (2013.01); *B22D 27/003* (2013.01); *B22D 27/15* (2013.01); *C22C 1/02* (2013.01); *C22F 1/08* (2013.01); *H01B 1/026* (2013.01); *H01R 13/03* (2013.01); *C22F 1/00* (2013.01)

(58) Field of Classification Search

CPC ..... C22C 9/00; C22C 1/02

See application file for complete search history.

(56) References Cited

U.S. PATENT DOCUMENTS

2004/0219054 A1 11/2004 Sugawara et al.

FOREIGN PATENT DOCUMENTS

| | | | |
|---|---|---|---|
| CN | 102453810 | A | 5/2012 |
| JP | 2004-176163 | A | 6/2004 |
| JP | 2004-231985 | A | 8/2004 |
| JP | 2005-097638 | | 4/2005 |
| JP | 2006-265611 | | 10/2006 |
| JP | 2012-097306 | | 5/2012 |
| JP | 2012-097307 | | 5/2012 |
| JP | 2012-188680 | | 10/2012 |
| JP | 2013-204140 | | 10/2013 |
| JP | 2014-084512 | | 5/2014 |
| JP | 2014-084514 | | 5/2014 |
| TW | 201038753 | A | 11/2010 |
| TW | 201217550 | A | 5/2012 |
| WO | WO-2014/064969 | A1 | 5/2014 |
| WO | WO-2014/064970 | A1 | 5/2014 |

OTHER PUBLICATIONS

Machine translation of TW 201217550, 2012.*
International Preliminary Report on Patentability and Written Opinion in International Application No. PCT/JP2014/074125 dated May 24, 2016, 6 pages.
Search Report in International Application No. PCT/JP2014/074125 dated Dec. 9, 2014, 4 pages.
Office Action in JP Application No. 2013-238335 dated Dec. 2, 2014, 2 pages.
Office Action in TW Application No. 10420964610 dated Jul. 22, 2015, 6 pages.
Office Action in CN Application No. 201480063082.2 dated Jan. 3, 2017, 4 pages.

* cited by examiner

*Primary Examiner* — Deborah Yee
(74) *Attorney, Agent, or Firm* — Marshall, Gerstein & Borun LLP

(57) ABSTRACT

There is provided a copper-titanium alloy with large fluctuations in Ti concentration. The copper-titanium alloy for electronic components contains 2.0 to 4.0% by mass of Ti and, as a third element, 0 to 0.5% by mass in total of one or more selected from a group consisting of Fe, Co, Mg, Si, Ni, Cr, Zr, Mo, V, Nb, Mn, B, and P, with a balance being copper and unavoidable impurities, wherein when crystal grains having <100> orientation in a section parallel to a rolling direction are subjected to area analysis of Ti concentration in a matrix phase, a difference between a maximum Ti concentration and a minimum Ti concentration is 5 to 16% by mass.

10 Claims, No Drawings

COPPER-TITANIUM ALLOY FOR ELECTRONIC COMPONENT

TECHNICAL FIELD

The present invention relates to a copper-titanium alloy suitable as a member for electronic components such as a connector.

BACKGROUND ART

In recent years, miniaturization of electronic equipment typified by a personal digital assistant and the like has increasingly advanced, and therefore, connectors for use therein have a significant tendency of having a narrow pitch, a low profile, and a narrow width. Since a smaller connector has a narrower pin width and takes a working shape folded into a small size, a high strength for obtaining required spring properties is required for a member to be used. From this point of view, a copper alloy containing titanium (hereinafter referred to as a "copper-titanium alloy") has a relatively high strength and is the most excellent in stress relaxation characteristics among copper alloys. Therefore, the copper-titanium alloy has been used for many years as materials for signal system terminals in which strength is particularly required.

The copper-titanium alloy is an age-hardening copper alloy. When a supersaturated solid solution of Ti which is a solute atom is formed by solution treatment, and the supersaturated solid solution is subjected to relatively long-time heat treatment at low temperatures, a modulated structure which is a periodic change of Ti concentration will develop in a matrix phase by spinodal decomposition, thereby improving strength. At this time, there is a problem in that strength and bending workability are mutually contradictory properties. That is, when strength is improved, bending workability will be impaired, and conversely, when bending workability is emphasized, desired strength will not be obtained. Generally, as the rolling reduction ratio in cold rolling is increased, dislocation introduced is increased to thereby increase dislocation density, which increases nucleation sites contributing to the precipitation and can increase the strength after aging treatment. However, if the rolling reduction ratio is excessively increased, bending workability will deteriorate. Therefore, it has been an object to achieve coexistence of strength and bending workability.

Thus, techniques for achieving coexistence of strength and bending workability of a copper-titanium alloy have been proposed from the point of view of adding a third element such as Fe, Co, Ni, and Si (Patent Literature 1), controlling the concentration of impurity elements which form a solid solution in a matrix phase and precipitating the impurity elements in a predetermined distribution form as second phase particles (Cu—Ti—X-based particles) to increase the regularity of modulated structure (Patent Literature 2), specifying elements to be added in a trace amount which are effective in forming fine crystal grains and the density of second phase particles (Patent Literature 3), forming fine crystal grains (Patent Literature 4), controlling the crystal orientation (Patent Literature 5), and the like.

Further, Patent Literature 6 discloses that as the modulated structure of titanium resulting from spinodal decomposition develops, the amplitude (difference between the highest concentration and the lowest concentration) of the change of titanium concentration increases, thereby imparting toughness to a copper-titanium alloy to improve strength and bending workability. Then, Patent Literature 6 proposes a technique of controlling the amplitude of Ti concentration in a matrix phase resulting from spinodal decomposition. Patent Literature 6 discloses that heat treatment (sub-aging treatment) is performed after final solution treatment to cause spinodal decomposition in advance, followed by performing a conventional cold rolling and a conventional aging treatment or aging treatment at a lower temperature for a shorter time than the conventional conditions, thereby increasing the amplitude of Ti concentration to achieve an increase in the strength of copper-titanium alloy.

CITATION LIST

Patent Literature

Patent Literature 1: Japanese Patent Laid-Open No. 2004-231985

Patent Literature 2: Japanese Patent Laid-Open No. 2004-176163

Patent Literature 3: Japanese Patent Laid-Open No. 2005-97638

Patent Literature 4: Japanese Patent Laid-Open No. 2006-265611

Patent Literature 5: Japanese Patent Laid-Open No. 2012-188680

Patent Literature 6: Japanese Patent Laid-Open No. 2012-097306

SUMMARY OF INVENTION

Technical Problem

Thus, although much effort has conventionally been made to achieve an improvement in properties in terms of both strength and bending workability, the miniaturization of electronic components such as a connector mounted has also been advanced by the miniaturization of electronic equipment. In order to follow such a technical trend, it is necessary to achieve the strength and bending workability of a copper-titanium alloy at a further higher level. It has been shown that an increase in the fluctuations of the Ti concentration resulting from spinodal decomposition is effective for improving the balance of strength and bending workability, but there is still room for improvement.

Therefore, an object of the present invention is to provide a copper-titanium alloy having further larger fluctuations of Ti concentration.

Solution to Problem

The present inventor has found that, in the production procedure of a copper-titanium alloy including final solution treatment→heat treatment (sub-aging treatment)→cold rolling→aging treatment as described in Patent Literature 6, the range (difference between the highest concentration and the lowest concentration) of Ti concentration by spinodal decomposition can be further increased by performing heat treatment after the final solution treatment in two steps, thereby further improving the balance of strength and bending workability. The present invention has been completed against the background of the above finding, and is specified by the following.

In one aspect, the present invention provides a copper-titanium alloy for electronic components containing 2.0 to 4.0% by mass of Ti and, as a third element(s), 0 to 0.5% by mass in total of one or more selected from a group consisting of Fe, Co, Mg, Si, Ni, Cr, Zr, Mo, V, Nb, Mn, B, and P, with a balance being copper and unavoidable impurities, wherein when crystal grains having <100> orientation in a section parallel to a rolling direction are subjected to area analysis of Ti concentration in a matrix phase, a difference between a maximum Ti concentration and a minimum Ti concentration is 5 to 16% by mass.

In another aspect, the present invention provides a copper-titanium alloy for electronic components containing 2.0 to 4.0% by mass of Ti and, as a third element(s), 0 to 0.5% by mass in total of one or more selected from a group consisting of Fe, Co, Mg, Si, Ni, Cr, Zr, Mo, V, Nb, Mn, B, and P, with a balance being copper and unavoidable impurities, wherein when crystal grains having <100> orientation in a section parallel to a rolling direction are subjected to area analysis of Ti concentration in a matrix phase, a standard deviation of Ti concentration is 1.0 to 4.0% by mass.

In one embodiment of the copper-titanium alloy according to the present invention, an average crystal grain size in a texture observation of a section parallel to a rolling direction is 2 to 30 μm.

In another embodiment of the copper-titanium alloy according to the present invention, a 0.2% yield strength in a direction parallel to a rolling direction is 900 MPa or more; and when Bad-way W-bending test (bending axis is in the same direction as rolling direction) is performed at a bending width of a sheet width (w)/sheet thickness (t)=3.0 and at a bending radius (R)/sheet thickness (t)=0, no crack occurs in a bent part.

In still another aspect, the present invention provides a wrought copper product comprising the copper-titanium alloy according to the present invention.

In still another aspect, the present invention provides an electronic component comprising the copper-titanium alloy according to the present invention.

Advantageous Effects of Invention

Since the copper-titanium alloy according to the present invention has a larger fluctuation of Ti concentration than before, the balance of strength and bending workability is further improved. A highly reliable electronic component such as a connector can be obtained by using as a material the copper-titanium alloy according to the present invention.

DESCRIPTION OF EMBODIMENTS (1) Ti Concentration

In the copper-titanium alloy according to the present invention, the Ti concentration is set to 2.0 to 4.0% by mass. In the copper-titanium alloy, strength and electric conductivity are increased by dissolving Ti in a Cu matrix by solution treatment and dispersing fine precipitates in the alloy by aging treatment.

If the Ti concentration is less than 2.0% by mass, the range of Ti concentration will not be produced or will be narrower, and the precipitation of precipitates will be insufficient, thereby preventing desired strength from being obtained. If the Ti concentration is more than 4.0% by mass, bending workability will deteriorate, and the material will be easily cracked during rolling. When the balance of strength and bending workability is taken into consideration, a preferred Ti concentration is 2.5 to 3.5% by mass.

(2) Third Element

In the copper-titanium alloy according to the present invention, strength can be further improved by incorporating one or more third elements selected from a group consisting of Fe, Co, Mg, Si, Ni, Cr, Zr, Mo, V, Nb, Mn, B, and P. However, if the sum concentration of the third elements is more than 0.5% by mass, bending workability will deteriorate, and the material will be easily cracked during rolling. Therefore, these third elements can be incorporated in a total amount of 0 to 0.5% by mass, and when the balance of strength and bending workability is taken into consideration, it is preferred to incorporate one or more of the above elements in a total amount of 0.1 to 0.4% by mass.

(3) Difference Between Maximum Ti Concentration and Minimum Ti Concentration and Standard Deviation of Ti Concentration In the present invention, a difference between a maximum Ti concentration and a minimum Ti concentration is specified as an index representing the change of the Ti concentration in a matrix phase. The analysis is performed by the energy dispersive X-ray spectroscopy (EDX) using a scanning transmission electron microscope (STEM) to a section parallel to a rolling direction (STEM-EDX analysis). When the matrix phase of a copper-titanium alloy is subjected to area analysis by STEM-EDX analysis, the Ti concentration will change depending on the point of measurement under the influence of spinodal decomposition. In the present invention, the minimum value and the maximum value of Ti concentration in 150 arbitrary points are measured in one visual field (at a magnification of 1,000,000 times, an observation visual field: 140 nm×140 nm), and the average value in five visual fields is defined as a measured value.

In the present invention, one of the features is that the change (fluctuations) of Ti concentration in the matrix phase of copper-titanium alloy is large. It is conceivable that toughness is thereby imparted to the copper-titanium alloy to improve strength and bending workability. In one embodiment of the copper-titanium alloy according to the present invention, when crystal grains having <100> orientation in a section parallel to a rolling direction are measured for the Ti concentration (% by mass) in a matrix phase, the difference between the maximum Ti concentration and the minimum Ti concentration is 5% by mass or more, preferably 6% by mass or more, more preferably 7% by mass or more, further preferably 8% by mass or more, and further more preferably 10% by mass or more.

The magnitude of the change of Ti concentration can also be expressed by a standard deviation of the Ti concentration. A standard deviation here is a standard deviation of Ti concentration calculated from the data of the Ti concentration in 150 points×5 visual fields obtained under the measurement conditions as described above. A large standard deviation means a large change of Ti concentration, and a small standard deviation means a small change of Ti concentration.

In one embodiment of the copper-titanium alloy according to the present invention, when crystal grains having <100> orientation in a section parallel to a rolling direction are measured for the Ti concentration in a matrix phase, a standard deviation of the Ti concentration is 1.0% by mass or more, preferably 1.5% by mass or more, more preferably 2.0% by mass or more.

On the other hand, if the change of the Ti concentration (% by mass) in a matrix phase is excessively large, coarse second phase particles will be readily precipitated, and conversely, strength and bending workability tend to be reduced. Therefore, in one embodiment of the copper-titanium alloy according to the present invention, the difference between the maximum Ti concentration (% by mass) and the minimum Ti concentration (% by mass) in a matrix phase is 16% by mass or less, preferably 15% by mass or less, more preferably 14% by mass or less. Further, in one embodiment of the copper-titanium alloy according to the present invention, a standard deviation of the Ti concentration in a matrix phase is 4.0% by mass or less, preferably 3.5% by mass or less, more preferably 3.0% by mass or less.

(4) 0.2% Yield Strength and Bending Workability

In one embodiment, when the copper-titanium alloy according to the present invention is subjected to tensile test according to JIS-Z2241, the 0.2% yield strength in the direction parallel to a rolling direction is 900 MPa or more; and when the copper-titanium alloy according to the present invention is subjected to Bad-way W-bending test (bending axis is in the same direction as rolling direction) according to JIS-H3130 at a bending width of a sheet width (w)/sheet thickness (t)=3.0 and at a bending radius (R)/sheet thickness (t)=0, no crack occurs in a bent part.

In a preferred embodiment, when the copper-titanium alloy according to the present invention is subjected to tensile test according to JIS-Z2241, the 0.2% yield strength in the direction parallel to a rolling direction is 1000 MPa or more; and when the copper-titanium alloy according to the present invention is subjected to Bad-way W-bending test (bending axis is in the same direction as rolling direction) according to JIS-H3130 at a bending width of a sheet width (w)/sheet thickness (t)=3.0 and at a bending radius (R)/sheet thickness (t)=0, no crack occurs in a bent part.

In a more preferred embodiment, when the copper-titanium alloy according to the present invention is subjected to tensile test according to JIS-Z2241, the 0.2% yield strength in the direction parallel to a rolling direction is 1050 MPa or more; and when the copper-titanium alloy according to the present invention is subjected to Bad-way W-bending test (bending axis is in the same direction as rolling direction) according to JIS-H3130 at a bending width of a sheet width (w)/sheet thickness (t)=3.0 and at a bending radius (R)/sheet thickness (t)=0, no crack occurs in a bent part.

In a further preferred embodiment, when the copper-titanium alloy according to the present invention is subjected to tensile test according to JIS-Z2241, the 0.2% yield strength in the direction parallel to a rolling direction is 1100 MPa or more; and when the copper-titanium alloy according to the present invention is subjected to Bad-way W-bending test (bending axis is in the same direction as rolling direction) according to JIS-H3130 at a bending width of a sheet width (w)/sheet thickness (t)=3.0 and at a bending radius (R)/sheet thickness (t)=0, no crack occurs in a bent part.

The upper limit of 0.2% yield strength is not particularly limited in terms of the strength targeted by the present invention. However, the 0.2% yield strength of the copper-titanium alloy according to the present invention is generally 1400 MPa or less, typically 1300 MPa or less, more typically 1200 MPa or less, since time and effort and expense are required for obtaining high strength, and there is a danger of cracking during hot rolling if Ti concentration is increased in order to obtain a high strength.

(5) Crystal Grain Size

In order to improve the strength and bending workability of a copper-titanium alloy, the smaller the crystal grains, the better. Therefore, the average crystal grain size is preferably 30 μm or less, more preferably 20 μm or less, further preferably 10 μm or less. The lower limit of the average crystal grain size is not particularly provided. However, if the crystal grains are intended to be so fine that the discrimination of the crystal grain size is difficult, mixed grains in which non-recrystallized grains are present will be produced, which, on the contrary, tends to deteriorate bending workability. Therefore, the average crystal grain size is preferably 2 μm or more. In the present invention, the average crystal grain size is represented by the equivalent circle diameter in the texture observation of a section parallel to a rolling direction when observed with an optical microscope or an electron microscope.

(6) Sheet Thickness of Copper-Titanium Alloy

The copper-titanium alloy according to the present invention may have a sheet thickness of 0.5 mm or less in one embodiment, 0.03 to 0.3 mm in a typical embodiment, and 0.08 to 0.2 mm in a more typical embodiment.

(7) Applications

The copper-titanium alloy according to the present invention can be processed into various wrought copper products, such as sheets, strips, tubes, rods, and wires. The copper-titanium alloy according to the present invention can be suitably used as a material for electronic components, such as connectors, switches, autofocus camera modules, jacks, terminals (such as battery terminals), and relays, but is not limited thereto.

(8) Production Method

The copper-titanium alloy according to the present invention can be produced by performing suitable heat treatment and cold rolling particularly in the final solution treatment and the steps thereafter. Hereinafter, suitable production examples will be successively described for each step.

<Production of Ingot>

The production of ingot by melting and casting is basically performed in vacuum or in an inert gas atmosphere. If some additive elements are not melted and remain in the melting, these elements will not effectively act to improve strength. Therefore, in order to reduce the melting residue, a third element having a high melting point such as Fe and Cr needs to be thoroughly stirred after being added and then held for a certain period of time. On the other hand, Ti may be added after the third element is melted since Ti relatively easily melts in Cu. Therefore, it is desirable to produce an ingot by adding, to Cu, one or more selected from a group consisting of Fe, Co, Mg, Si, Ni, Cr, Zr, Mo, V, Nb, Mn, B, and P so as to be contained in a total amount of 0 to 0.5% by mass and then adding Ti so as to be contained in an amount of 2.0 to 4.0% by mass.

<Homogenizing Annealing and Hot Rolling>

Materials produced by solidifying segregation and crystallization during ingot production are coarse. Therefore, these materials should be desirably dissolved in a matrix phase for miniaturization and elimination to the extent possible by homogenizing annealing. This is effective for preventing a bending crack. Specifically, after the step of producing an ingot, the ingot is preferably heated to 900 to 970° C. for 3 to 24 hours to perform homogenizing annealing followed by performing hot rolling. In order to prevent liquid metal brittleness, the temperature is preferably 960° C. or less before hot rolling and during hot rolling, and the temperature in the pass from the original thickness to a total rolling reduction ratio of 90% is preferably 900° C. or more.

<First Solution Treatment>

Subsequently, it is preferred to perform a first solution treatment after arbitrarily repeating cold rolling and annealing. The reason for performing solution treatment in advance here is to reduce a burden in the final solution treatment. That is, the final solution treatment is not a heat treatment to dissolve second phase particles but may be a milder heat treatment because the alloy has already been subjected to solution treatment, and what is necessary is only to cause recrystallization while maintaining the dissolved state. Specifically, the first solution treatment may be performed at a heating temperature of 850 to 900° C. for 2 to 10 minutes. The heating rate and cooling rate for the first solution treatment are preferably as high as possible so that the second phase particles may not be precipitated here. Note that the first solution treatment may not be performed.

<Intermediate Rolling>

The higher the rolling reduction ratio in the intermediate rolling before the final solution treatment, the more uniformly and finely the recrystallized grains in the final solution treatment can be controlled. Therefore, the rolling reduction ratio in the intermediate rolling is preferably 70 to 99%. The rolling reduction ratio is defined by {(thickness before rolling−thickness after rolling)/(thickness before rolling)×100%}.

<Final Solution Treatment>

In the final solution treatment, it is desirable to completely dissolve precipitates, but if heated to high temperatures until the precipitates completely disappear, crystal grains are likely to be coarsened. Therefore, the heating temperature is set to a temperature in the vicinity of the solubility limit of the second phase particle composition (the temperature at which the solubility limit of Ti is equal to the amount of Ti added in the range where the amount of Ti added is 2.0 to 4.0% by mass is about 730 to 840° C., for example, about 800° C. when the amount of Ti added is 3.0% by mass). Then, when the alloy is rapidly heated to the above temperatures and the cooling rate is also increased by water cooling or the like, the production of coarse second phase particles will be suppressed. Therefore, the alloy is typically heated to a temperature −20° C. to +50° C. with respect to the temperature at which the solubility limit of Ti is equal to the added amount of Ti within the range of 730 to 840° C.; and the alloy is more typically heated to a temperature higher by 0 to 30° C., preferably 0 to 20° C., than the temperature at which the solubility limit of Ti is equal to the added amount of Ti within the range of 730 to 880° C.

Further, the formation of coarse crystal grains can be suppressed by reducing the heating time in the final solution treatment. The heating time may be 30 seconds to 10 minutes for example, typically 1 minute to 8 minutes. Even if second phase particles are produced at this time point, they will be almost harmless to strength and bending workability as long as they are dispersed finely and uniformly. However, since coarse particles tend to further grow in the final aging treatment, the second phase particles if produced at this time point must be as small as possible in the amount and in the size thereof.

<Preliminary Aging>

The final solution treatment is followed by preliminary aging treatment. Conventionally, it has been common to perform cold rolling after the final solution treatment. However, for obtaining the copper-titanium alloy according to the present invention, it is important to immediately perform preliminary aging treatment after the final solution treatment without performing cold rolling. The preliminary aging treatment is a heat treatment performed at temperatures lower than the temperature in the next step of aging treatment. The fluctuations of Ti concentration in the matrix phase of a copper-titanium alloy can be dramatically increased by performing the preliminary aging treatment and the aging treatment in series to be described below. The preliminary aging treatment is preferably performed in an inert atmosphere, such as Ar, N2, and H2, in order to suppress the production of a surface oxide film.

It is difficult to obtain the above advantage if the heating temperature in the preliminary aging treatment is too low or too high. According to the investigation results by the present inventor, the heating is conducted preferably at a material temperature of 150 to 250° C. for 10 to 20 hours, more preferably at a material temperature of 160 to 230° C. for 10 to 18 hours, further preferably at a material temperature of 170 to 200° C. for 12 to 16 hours.

<Aging Treatment>

The preliminary aging treatment is followed by aging treatment. The alloy may be once cooled to room temperature after the preliminary aging treatment. Considering production efficiency, after the preliminary aging treatment, the alloy is desirably heated to the aging treatment temperature without cooling and continuously subjected to aging treatment. There is no difference in the characteristics of the resulting copper-titanium alloy between the both methods. However, since the preliminary aging is performed for the purpose of uniformly precipitating second phase particles in the subsequent aging treatment, cold rolling should not be performed between the preliminary aging treatment and the aging treatment.

Since titanium dissolved in the solution treatment is slightly precipitated by the preliminary aging treatment, the aging treatment should be performed at a slightly lower temperature than the temperature in a conventional aging treatment. The heating is preferably conducted at a material temperature of 300 to 450° C. for 0.5 to 20 hours, more preferably at a material temperature of 350 to 440° C. for 2 to 18 hours, further preferably at a material temperature of 375 to 430° C. for 3 to 15 hours. The aging treatment is preferably performed in an inert atmosphere, such as Ar, N2, and H2, for the same reason as in the preliminary aging treatment.

<Final Cold Rolling>

The above aging treatment is followed by the final cold rolling. The final cold working can increase the strength of a copper-titanium alloy, but in order to obtain good balance of high strength and bending workability intended by the present invention, the rolling reduction ratio is desirably set to 10 to 50%, preferably 20 to 40%.

<Stress Relief Annealing>

From the point of view of improving the permanent set resistance when exposed to high temperatures, it is desired to perform stress relief annealing after the final cold rolling. This is because the dislocation is rearranged by performing the stress relief annealing. The conditions of stress relief annealing may be a conventional condition, but excessive stress relief annealing is not preferred since coarse particles will be precipitated, resulting in reduced strength. The stress relief annealing is preferably performed at a material temperature of 200 to 600° C. for 10 to 600 seconds, more preferably at a material temperature of 250 to 550° C. for 10 to 400 seconds, further preferably at a material temperature of 300 to 500° C. for 10 to 200 seconds.

Note that a person skilled in the art will be able to understand that the steps of grinding, polishing, shot blasting-pickling, and the like for removing oxidized scale on the surface may be suitably performed between each of the above steps.

Examples

Hereinafter, Examples (Inventive Examples) of the present invention will be shown together with Comparative Examples. However, these examples are provided in order to better understand the present invention and its advantage, and the present invention is not intended to be limited to these Examples.

The test pieces of copper-titanium alloys each containing the alloy components shown in Table 1 (Tables 1-1 and 1-2) with a balance being copper and unavoidable impurities were prepared under various production conditions, and the difference between the maximum Ti concentration and the minimum Ti concentration in the matrix phase, 0.2% yield strength, and bending workability were investigated, respectively.

First, 2.5 kg of electrolytic copper was melted in a vacuum melting furnace, and thereto was added each third element in a blending rate shown in Table 1, followed by adding Ti in a blending rate shown in the same table. The holding time after adding these elements was sufficiently taken into consideration so that the melting residue of the additive elements might not be present. Then, the above components were poured into a mold in an Ar atmosphere to produce respectively about 2 kg of an ingot.

The above ingot was subjected to homogenizing annealing in which the ingot was heated at 950° C. for 3 hours and then subjected to hot rolling at 900 to 950° C. to obtain a hot-rolled sheet having a thickness of 15 mm. After the descaling by face milling, the hot-rolled sheet was subjected to cold rolling to the thickness (1 to 8 mm) of a crude strip, and the crude strip was subjected to a first solution treatment. The first solution treatment was performed under the conditions of heating at 850° C. for 10 minutes followed by water cooling. Next, an intermediate cold rolling was performed at a rolling reduction ratio adjusted depending on the conditions of the rolling reduction ratio in the final cold rolling and the product thickness as described in Table 1. Then, the cold-rolled sheet was inserted into an annealing furnace which allows rapid heating to perform the final solution treatment, followed by water cooling. The heating condition at this time was set as described in Table 1 based on a material temperature at which the solubility limit of Ti is equal to the added amount of Ti (about 800° C. at a Ti concentration of 3.0% by mass, about 730° C. at a Ti concentration of 2.0% by mass, about 840° C. at a Ti concentration of 4.0% by mass). Next, the preliminary aging treatment and aging treatment were performed in series under the conditions described in Table 1 in an Ar atmosphere. Here, cooling was not performed after the preliminary aging treatment. The final cold rolling was performed under the conditions described in Table 1 after the descaling by pickling, and stress relief annealing was finally performed under each heating condition described in Table 1 to prepare test pieces for Inventive Examples and Comparative Examples. Depending on test pieces, the preliminary aging treatment, the aging treatment, or the stress relief annealing was omitted.

The product samples prepared were evaluated for the following.

(a) 0.2% Yield Strength

A JIS13B test piece was prepared, and the 0.2% yield strength of the test piece in the direction parallel to a rolling direction was determined using a tensile testing apparatus according to JIS-Z2241.

(b) Bending Workability

The Bad-way W-bending test (bending axis is in the same direction as rolling direction) was performed according to JIS-H3130 at a bending width of a sheet width (w)/sheet thickness (t)=3.0, and the minimum bending radius ratio (MBR/t), which is the ratio of the minimum bending radius (MBR) at which no crack occurs to the thickness (t), was determined. At this time, the presence or absence of the crack was determined by whether or not a crack had occurred in a bent part when the section of the bent part was mirror finished by mechanical polishing and observed with an optical microscope.

(c) STEM-EDX Analysis

For each test piece, a section parallel to a rolling direction was exposed by cutting the rolling surface with a focused ion beam (FIB), and then the sample was processed to a thickness of about 100 nm or less to observe the section. The observation was performed using a scanning transmission electron microscope (JEOL Ltd., model: JEM-2100F) and using an energy dispersive X-ray spectrometer (EDX) as a detector at a sample inclination angle of 0°, an acceleration voltage of 200 kV, and an electron beam spot diameter of 0.2 nm. Then, the observation was performed at an observation magnification of 1,000,000 times and at an observation visual field per one visual field of 140 nm×140 nm, and the Ti concentration in 150 arbitrary points was analyzed. Note that, in order to prevent the measurement error by the influence of a precipitate, a location where no precipitate was present was selected as a measurement point.

The minimum value and the maximum value of Ti concentration were determined for each visual field, and the difference between these values was calculated. The same analysis was repeated 5 times in different observation visual fields, and the average of the differences was calculated and defined as a measured value of the difference between the maximum Ti concentration and the minimum Ti concentration.

(d) Crystal Grain Size

Further, with respect to the measurement of the average crystal grain size of each product sample, a section parallel to a rolling direction was exposed by cutting the rolling surface with FIB. Then, the section was observed using an electron microscope (XL30 SFEG, manufactured by Philips Inc.), and the number of crystal grains per unit area was counted to determine the average equivalent circle diameter of crystal grains. Specifically, a frame having a size of 100 μm×100 μm was prepared, and the number of crystal grains present in the frame was counted. Note that crystal grains crossing the frame were all counted as a ½ piece. The area of the frame, 10000 μm2, divided by the sum of the number of crystal grains is the average value of the area per crystal grain. The diameter of a perfect circle having the average area per crystal grain is an equivalent circle diameter, which was defined as the average crystal grain size.

(Discussion)

Test results are shown in Table 1 (Tables 1-1 and 1-2). Inventive Example 1 shows that since the conditions of the final solution treatment, preliminary aging, aging, and final cold rolling were respectively suitable, the difference between the maximum Ti concentration and the minimum Ti concentration increased, and coexistence of 0.2% yield strength and bending workability was achieved at a high level.

In Inventive Example 2, the heating temperature of the preliminary aging was set to a temperature lower than that in Inventive Example 1. Thereby, the difference between the maximum Ti concentration and the minimum Ti concentration was reduced, but good 0.2% yield strength and bending workability were still able to be secured.

In Inventive Example 3, the heating temperature of the preliminary aging was set to a temperature higher than that in Inventive Example 1. Thereby, the difference between the maximum Ti concentration and the minimum Ti concentration increased, and 0.2% yield strength was improved while maintaining high bending workability.

In Inventive Example 4, the heating temperature of aging was set to a temperature lower than that in Inventive Example 1. Thereby, the difference between the maximum Ti concentration and the minimum Ti concentration was reduced, but good 0.2% yield strength and bending workability were still able to be secured.

In Inventive Example 5, the heating temperature of aging was set to a temperature higher than that in Inventive Example 1. Thereby, the difference between the maximum Ti concentration and the minimum Ti concentration increased, and 0.2% yield strength was improved.

In Inventive Example 6, the rolling reduction ratio in the final cold rolling was set to a value lower than that in Inventive Example 1. Thereby, 0.2% yield strength was decreased to a value lower than that in Inventive Example 1, but good 0.2% yield strength and bending workability were still able to be secured.

In Inventive Example 7, the rolling reduction ratio in the final cold rolling was set to a value higher than that in Inventive Example 1. Thereby, 0.2% yield strength was improved while maintaining high bending workability.

In Inventive Example 8, the stress relief annealing was omitted from Inventive Example 1, but good 0.2% yield strength and bending workability were still able to be secured.

In Inventive Example 9, the heating temperature of stress relief annealing was set to a value higher than that in Inventive Example 1. Thereby, the difference between the maximum Ti concentration and the minimum Ti concentration increased close to the upper limit, but good 0.2% yield strength and bending workability were still able to be secured.

Inventive Example 10 is an example in which the addition of a third element was omitted from Inventive Example 1. Although some reduction in 0.2% yield strength was observed, good 0.2% yield strength and bending workability were still able to be secured.

Inventive Example 11 is an example in which the Ti concentration in the copper-titanium alloy in Inventive Example 1 was reduced close to the lower limit. Although the difference between the maximum Ti concentration and the minimum Ti concentration was reduced to result in some reduction in 0.2% yield strength, good 0.2% yield strength and bending workability were still able to be secured.

In Inventive Example 12, the Ti concentration in the copper-titanium alloy in Inventive Example 1 increased close to the upper limit. Thereby, the difference between the maximum Ti concentration and the minimum Ti concentration increased close to the upper limit, but good 0.2% yield strength and bending workability were still able to be secured.

Inventive Examples 13 to 18 are examples in which the type of a third element was changed from that in Inventive Example 1, but good 0.2% yield strength and bending workability were still able to be secured.

In Comparative Example 1, the temperature of the final solution treatment was excessively low. Thereby, the mixing of grains occurred in which a non-recrystallized region and a recrystallized region were mixed, and the difference between the maximum Ti concentration and the minimum Ti concentration was reduced. Therefore, bending workability was poor.

In Comparative Example 2, no preliminary aging treatment was performed. Thereby, an increase in the difference between the maximum Ti concentration and the minimum Ti concentration was insufficient, resulting in poor bending workability.

Comparative Examples 3 to 4 correspond to the copper-titanium alloy described in Patent Literature 6. Preliminary aging treatment and aging treatment was not performed in series. Thereby, an increase in the difference between the maximum Ti concentration and the minimum Ti concentration was insufficient, resulting in poor bending workability.

In Comparative Example 5, the preliminary aging treatment was performed, but the heating temperature was excessively low. Thereby, the difference between the maximum Ti concentration and the minimum Ti concentration did not sufficiently increase, resulting in poor bending workability.

In Comparative Example 6, the heating temperature in the preliminary aging was excessively high, resulting in over-aging in which the difference between the maximum Ti concentration and the minimum Ti concentration excessively increased, and a part of stable phases which was not able to endure the fluctuations precipitated as coarse particles, resulting in a reduction in bending workability.

In Comparative Example 7, aging treatment was not performed. Thereby, spinodal decomposition was insufficient, resulting in insufficient difference between the maximum Ti concentration and the minimum Ti concentration. Thereby, 0.2% yield strength and bending workability were lower than those in Inventive Example 1.

Comparative Example 8 is a case in which it can be evaluated that final solution treatment→cold rolling→aging treatment were performed. The difference between the maximum Ti concentration and the minimum Ti concentration was insufficient, and 0.2% yield strength and bending workability were lower than those in Inventive Example 1.

In Comparative Example 9, the heating temperature of aging was excessively low. Thereby, the difference between the maximum Ti concentration and the minimum Ti concentration was insufficient, and 0.2% yield strength and bending workability were lower than those in Inventive Example 1.

In Comparative Example 10, the heating temperature of aging was excessively high, resulting in over-aging in which the difference between the maximum Ti concentration and the minimum Ti concentration excessively increased, and a part of stable phases which was not able to endure the fluctuations precipitated as coarse particles. Thereby, 0.2% yield strength and bending workability were lower than those in Inventive Example 1.

In Comparative Example 11, the heating temperature of stress relief annealing was excessively high, resulting in an excessive difference between the maximum Ti concentration and the minimum Ti concentration, and a part of stable phases which was not able to endure the fluctuations precipitated as coarse particles. Thereby, 0.2% yield strength and bending workability were lower than those in Inventive Example 1.

In Comparative Example 12, the added amount of a third element was excessively large. Thereby, a crack occurred in hot rolling, which prevented the production of a test piece.

In Comparative Example 13, the Ti concentration was excessively low. Thereby, the difference between the maximum Ti concentration and the minimum Ti concentration was reduced, resulting in insufficient strength.

In Comparative Example 14, the Ti concentration was excessively high. Thereby, a crack occurred in hot rolling, which prevented the production of a test piece.

TABLE 1-1

| Example | Component (mass %) Ti | Component (mass %) Third element | Final solution treatment Condition | Preliminary aging Condition | Aging Condition | Final rolling Rolling reduction ratio (%) | Stress relief annealing Condition |
|---|---|---|---|---|---|---|---|
| Inventive Example 1 | 3.2 | 0.2Fe | 820° C. × 2.0 min | 200° C. × 15 h | 400° C. × 15 h | 25 | 375° C. × 60 s |
| Inventive Example 2 | 3.2 | 0.2Fe | 820° C. × 2.0 min | 150° C. × 20 h | 400° C. × 15 h | 25 | 375° C. × 60 s |
| Inventive Example 3 | 3.2 | 0.2Fe | 820° C. × 2.0 min | 250° C. × 10 h | 400° C. × 15 h | 25 | 375° C. × 60 s |
| Inventive Example 4 | 3.2 | 0.2Fe | 820° C. × 2.0 min | 200° C. × 15 h | 300° C. × 20 h | 25 | 375° C. × 60 s |
| Inventive Example 5 | 3.2 | 0.2Fe | 820° C. × 2.0 min | 200° C. × 15 h | 450° C. × 2 h | 25 | 375° C. × 60 s |
| Inventive Example 6 | 3.2 | 0.2Fe | 820° C. × 3.0 min | 200° C. × 15 h | 400° C. × 15 h | 10 | 375° C. × 60 s |
| Inventive Example 7 | 3.2 | 0.2Fe | 820° C. × 2.0 min | 200° C. × 15 h | 400° C. × 15 h | 50 | 375° C. × 60 s |
| Inventive Example 8 | 3.2 | 0.2Fe | 820° C. × 4.0 min | 200° C. × 15 h | 400° C. × 15 h | 25 | — |
| Inventive Example 9 | 3.2 | 0.2Fe | 820° C. × 4.0 min | 200° C. × 15 h | 400° C. × 15 h | 25 | 600° C. × 10 s |
| Inventive Example 10 | 3.2 | — | 800° C. × 2.0 min | 200° C. × 15 h | 400° C. × 10 h | 30 | 400° C. × 45 s |
| Inventive Example 11 | 2.0 | — | 770° C. × 2.0 min | 200° C. × 15 h | 320° C. × 10 h | 30 | 375° C. × 60 s |
| Inventive Example 12 | 4.0 | — | 850° C. × 2.0 min | 250° C. × 10 h | 420° C. × 15 h | 30 | 375° C. × 60 s |
| Inventive Example 13 | 3.2 | 0.1Zr | 840° C. × 1.0 min | 250° C. × 10 h | 400° C. × 10 h | 25 | 350° C. × 60 s |
| Inventive Example 14 | 3.2 | 0.1Co—0.1Si | 860° C. × 1.0 min | 150° C. × 20 h | 400° C. × 15 h | 25 | 350° C. × 60 s |
| Inventive Example 15 | 3.2 | 0.1Ni—0.1V—0.1Mg | 850° C. × 1.0 min | 150° C. × 20 h | 400° C. × 15 h | 40 | 350° C. × 60 s |
| Inventive Example 16 | 3.2 | 0.1Mo—0.1B | 820° C. × 6.0 min | 250° C. × 10 h | 400° C. × 10 h | 15 | 350° C. × 60 s |
| Inventive Example 17 | 3.2 | 0.15Mn—0.1Cr | 840° C. × 5.0 min | 250° C. × 10 h | 400° C. × 10 h | 25 | 350° C. × 60 s |
| Inventive Example 18 | 3.2 | 0.2Fe—0.1P—0.1Nb | 850° C. × 5.0 min | 200° C. × 15 h | 400° C. × 10 h | 25 | 350° C. × 60 s |
| Comparative Example 1 | 3.2 | 0.2Fe | 680° C. × 4.0 min | 200° C. × 15 h | 400° C. × 15 h | 25 | 375° C. × 60 s |
| Comparative Example 2 | 3.2 | 0.2Fe | 820° C. × 2.0 min | — | 400° C. × 15 h | 25 | 375° C. × 60 s |
| Comparative Example 3 | 3.2 | 0.2Fe | 820° C. × 4.0 min | — | 350° C. × 3 h | 30 | 380° C. × 5 h |
| Comparative Example 4 | 3.2 | 0.2Fe | 820° C. × 4.0 min | — | 550° C. × 30 s | 30 | 350° C. × 5 h |
| Comparative Example 5 | 3.2 | 0.2Fe | 820° C. × 2.0 min | 100° C. × 20 h | 400° C. × 15 h | 25 | 375° C. × 60 s |
| Comparative Example 6 | 3.2 | 0.2Fe | 820° C. × 2.0 min | 300° C. × 10 h | 400° C. × 15 h | 25 | 375° C. × 60 s |
| Comparative Example 7 | 3.2 | 0.2Fe | 820° C. × 2.0 min | 200° C. × 15 h | — | 25 | 375° C. × 60 s |
| Comparative Example 8 | 3.2 | 0.2Fe | 820° C. × 4.0 min | — | — | 30 | 400° C. × 5 h |
| Comparative Example 9 | 3.2 | 0.2Fe | 820° C. × 2.0 min | 200° C. × 15 h | 250° C. × 20 h | 25 | 375° C. × 60 s |
| Comparative Example 10 | 3.2 | 0.2Fe | 820° C. × 2.0 min | 200° C. × 15 h | 500° C. × 2 h | 25 | 375° C. × 60 s |
| Comparative Example 11 | 3.2 | 0.2Fe | 820° C. × 4.0 min | 200° C. × 15 h | 400° C. × 15 h | 25 | 650° C. × 10 s |
| Comparative Example 12 | 3.2 | 0.3Si—0.2Co—0.1Mg | | | Impossible to produce | | |
| Comparative Example 13 | 1.5 | — | 740° C. × 2.0 min | 200° C. × 15 h | 400° C. × 15 h | 25 | 375° C. × 60 s |
| Comparative Example 14 | 4.5 | — | | | Impossible to produce | | |

TABLE 1-2

| Example | Final properties: Crystal grain size (μm) | Product thickness (mm) | 0.2% yield strength (MPa) | Bending width (mm) | MBR/t (—) | Spinodal decomposition: Ti concentration range (mass %) | Standard deviation (mass %) |
|---|---|---|---|---|---|---|---|
| Inventive Example 1 | 6 | 0.070 | 1020 | 0.21 | 0 | 7.0 | 2.25 |
| Inventive Example 2 | 8 | 0.070 | 1005 | 0.21 | 0 | 5.2 | 2.04 |
| Inventive Example 3 | 4 | 0.070 | 1033 | 0.21 | 0 | 8.8 | 2.64 |
| Inventive Example 4 | 6 | 0.070 | 989 | 0.21 | 0 | 5.8 | 1.88 |
| Inventive Example 5 | 9 | 0.070 | 995 | 0.21 | 0 | 13.5 | 3.34 |
| Inventive Example 6 | 10 | 0.120 | 913 | 0.36 | 0 | 6.5 | 2.31 |
| Inventive Example 7 | 6 | 0.050 | 1167 | 0.15 | 0 | 7.5 | 2.54 |

TABLE 1-2-continued

| Example | Final properties | | | | | Spinodal decomposition | |
|---|---|---|---|---|---|---|---|
| | Crystal grain size (μm) | Product thickness (mm) | 0.2% yield strength (MPa) | Bending width (mm) | MBR/t (—) | Ti concentration range (mass %) | Standard deviation (mass %) |
| Inventive Example 8 | 5 | 0.120 | 1023 | 0.36 | 0 | 6.5 | 2.07 |
| Inventive Example 9 | 7 | 0.120 | 1013 | 0.36 | 0 | 13.3 | 3.34 |
| Inventive Example 10 | 19 | 0.080 | 1004 | 0.24 | 0 | 7.7 | 2.78 |
| Inventive Example 11 | 12 | 0.080 | 974 | 0.24 | 0 | 5.2 | 1.15 |
| Inventive Example 12 | 22 | 0.080 | 1054 | 0.24 | 0 | 14.1 | 3.44 |
| Inventive Example 13 | 8 | 0.050 | 1037 | 0.15 | 0 | 6.6 | 1.54 |
| Inventive Example 14 | 26 | 0.050 | 986 | 0.15 | 0 | 8.6 | 2.94 |
| Inventive Example 15 | 15 | 0.050 | 1105 | 0.15 | 0 | 10.0 | 3.21 |
| Inventive Example 16 | 12 | 0.200 | 1040 | 0.60 | 0 | 15.6 | 3.91 |
| Inventive Example 17 | 26 | 0.150 | 1010 | 0.45 | 0 | 14.5 | 3.57 |
| Inventive Example 18 | 7 | 0.150 | 1038 | 0.45 | 0 | 11.5 | 3.19 |
| Comparative Example 1 | Non-recrystallized | 0.150 | 1021 | 0.45 | 5.3 | 3.5 | 0.34 |
| Comparative Example 2 | 6 | 0.070 | 1017 | 0.21 | 1.1 | 3.8 | 0.52 |
| Comparative Example 3 | 7 | 0.150 | 1031 | 0.45 | 2.0 | 4.2 | 0.74 |
| Comparative Example 4 | 8 | 0.150 | 1064 | 0.45 | 2.0 | 4.7 | 0.81 |
| Comparative Example 5 | 8 | 0.070 | 1015 | 0.21 | 1.1 | 3.4 | 0.51 |
| Comparative Example 6 | 9 | 0.070 | 1009 | 0.21 | 2.1 | 17.5 | 4.31 |
| Comparative Example 7 | 7 | 0.070 | 851 | 0.21 | 0.7 | 1.1 | 0.31 |
| Comparative Example 8 | 9 | 0.150 | 938 | 0.45 | 2.0 | 2.5 | 0.64 |
| Comparative Example 9 | 8 | 0.070 | 933 | 0.21 | 1.1 | 3.9 | 0.59 |
| Comparative Example 10 | 8 | 0.070 | 927 | 0.21 | 1.8 | 18.0 | 4.47 |
| Comparative Example 11 | 6 | 0.150 | 970 | 0.45 | 2.7 | 18.2 | 4.32 |
| Comparative Example 12 | Impossible to produce | | | | | | |
| Comparative Example 13 | 22 | 0.070 | 824 | 0.21 | 0 | 0.7 | 0.37 |
| Comparative Example 14 | Impossible to produce | | | | | | |

The invention claimed is:

1. A copper-titanium alloy for electronic components containing 2.0% to 4.0% by mass of Ti and, as a third element(s), 0% to 0.5% by mass in total of one or more selected from the group consisting of Fe, Co, Mg, Si, Ni, Cr, Zr, Mo, V, Nb, Mn, B, and P, with a balance being copper and unavoidable impurities, wherein when crystal grains having <100> orientation in a section parallel to a rolling direction are subjected to area analysis of Ti concentration in a matrix phase, a difference between a maximum Ti concentration and a minimum Ti concentration is 5% to 16% by mass.

2. A copper-titanium alloy for electronic components containing 2.0% to 4.0% by mass of Ti and, as a third element(s), 0% to 0.5% by mass in total of one or more selected from the group consisting of Fe, Co, Mg, Si, Ni, Cr, Zr, Mo, V, Nb, Mn, B, and P, with a balance being copper and unavoidable impurities, wherein when crystal grains having <100> orientation in a section parallel to a rolling direction are subjected to area analysis of Ti concentration in a matrix phase, a standard deviation of Ti concentration is 1.0% to 4.0% by mass.

3. The copper-titanium alloy according to claim 1, wherein an average crystal grain size in a texture observation of a section parallel to a rolling direction is 2 μm to 30 μm.

4. The copper-titanium alloy according to claim 1, wherein a 0.2% yield strength in a direction parallel to a rolling direction is 900 MPa or more; and when Bad-way W-bending test (bending axis is in the same direction as a rolling direction) is performed at a bending width of a sheet width (w)/sheet thickness (t)=3.0 and at a bending radius (R)/sheet thickness (t)=0, no crack occurs in a bent part.

5. A wrought copper product comprising the copper-titanium alloy according to claim 1.

6. An electronic component comprising the copper-titanium alloy according to claim 1.

7. The copper-titanium alloy according to claim 2, wherein an average crystal grain size in a texture observation of a section parallel to a rolling direction is 2 μm to 30 μm.

8. The copper-titanium alloy according to claim 2, wherein a 0.2% yield strength in a direction parallel to a rolling direction is 900 MPa or more; and when Bad-way W-bending test (bending axis is in the same direction as a rolling direction) is performed at a bending width of a sheet width (w)/sheet thickness (t)=3.0 and at a bending radius (R)/sheet thickness (t)=0, no crack occurs in a bent part.

9. A wrought copper product comprising the copper-titanium alloy according to claim 2.

10. An electronic component comprising the copper-titanium alloy according to claim 2.

* * * * *